US012258155B2

(12) United States Patent
Fukuda et al.

(10) Patent No.: US 12,258,155 B2
(45) Date of Patent: Mar. 25, 2025

(54) AUTOMATIC BUNDLING TOOL DEVICE

(71) Applicant: HELLERMANNTYTON GmbH, Tornesch (DE)

(72) Inventors: Taro David Fukuda, Hamburg (DE); Andreas Schwinn, Hamburg (DE)

(73) Assignee: HELLERMANNTYTON GmbH, Tornesch (DE)

( * ) Notice: Subject to any disclaimer, the term of this patent is extended or adjusted under 35 U.S.C. 154(b) by 267 days.

(21) Appl. No.: 17/936,690

(22) Filed: Sep. 29, 2022

(65) Prior Publication Data

US 2023/0104154 A1 Apr. 6, 2023

(30) Foreign Application Priority Data

Oct. 1, 2021 (DE) ..... 202021105310.0
Feb. 24, 2022 (DE) ..... 202022101064.1

(51) Int. Cl.
*B65B 13/02* (2006.01)
*B65B 13/18* (2006.01)
*B65B 13/22* (2006.01)

(52) U.S. Cl.
CPC ..... *B65B 13/027* (2013.01); *B65B 13/187* (2013.01); *B65B 13/22* (2013.01)

(58) Field of Classification Search
CPC ..... B65B 13/027; B65B 13/187; B65B 13/22; B25B 25/00
See application file for complete search history.

(56) References Cited

U.S. PATENT DOCUMENTS 3,865,156 A 2/1975 Moody et al.
4,371,010 A 2/1983 Hidassy
4,495,972 A 1/1985 Walker
4,534,817 A 8/1985 O'Sullivan
4,790,225 A 12/1988 Moody et al.
(Continued)

FOREIGN PATENT DOCUMENTS

CN 1100054 3/1995
CN 1660675 8/2005
(Continued)

OTHER PUBLICATIONS

"Autotool 2000 CPK Operating Instructions", Hellerman Tyton, 106-29006, Apr. 2, 2015, 29 pages.
(Continued)

*Primary Examiner* — Teresa M Ekiert
(74) *Attorney, Agent, or Firm* — Colby Nipper PLLC

(57) ABSTRACT

This publication describes automatic bundling tool devices capable of tightening one-piece-ties with increased tolerance with respect to the thickness of the one-piece-tie (OPT) strap. In an aspect, disclosed is a bundling tool device that includes a tightening mechanism with a tightening gear unit with a tightening gear, and with a tightening roller unit with two tightening rollers, forming a gap in between tightening gear and tightening rollers. The gap is configured to hold a strap of a respective OPT processed by the device. The tightening gear includes teeth which are configured to fit into a serration of the strap. The tightening roller unit includes a lever with the two tightening rollers being arranged on the lever in a first end section of the lever, a turning point of the lever being arranged in a middle section of the lever, and an adjustment element of the tightening roller unit.

20 Claims, 2 Drawing Sheets

(56) References Cited

U.S. PATENT DOCUMENTS

| | | | |
|---|---|---|---|
| 4,793,385 | A | 12/1988 | Dyer et al. |
| D306,390 | S | 3/1990 | Dyer |
| 4,997,011 | A | 3/1991 | Dyer et al. |
| 5,205,328 | A | 4/1993 | Johnson |
| 5,287,802 | A | 2/1994 | Pearson |
| 5,417,252 | A | 5/1995 | Kurmis |
| 5,492,156 | A | 2/1996 | Dyer et al. |
| 5,595,220 | A | 1/1997 | Leban et al. |
| 5,769,133 | A | 6/1998 | Dyer et al. |
| 5,809,873 | A | 9/1998 | Chak et al. |
| 5,845,681 | A | 12/1998 | Kurmis |
| 5,909,751 | A | 6/1999 | Teagno |
| 5,915,425 | A | 6/1999 | Nilsson et al. |
| 5,921,290 | A | 7/1999 | Dyer et al. |
| D430,781 | S | 9/2000 | Hillegonds |
| 6,119,734 | A | 9/2000 | Kurmis |
| 6,206,053 | B1 | 3/2001 | Hillegonds |
| 6,302,157 | B1 | 10/2001 | Deschenes et al. |
| 6,354,336 | B1 | 3/2002 | Leban |
| 6,401,766 | B1 | 6/2002 | Ishikawa |
| 6,497,258 | B1 | 12/2002 | Flannery et al. |
| D473,773 | S | 4/2003 | Hillegonds et al. |
| 6,543,341 | B2 | 4/2003 | Lopez |
| D491,430 | S | 6/2004 | Magno et al. |
| 6,751,828 | B2 | 6/2004 | Matschiner et al. |
| 6,840,289 | B2 | 1/2005 | Hillegonds |
| D510,244 | S | 10/2005 | Magno et al. |
| 6,981,528 | B2 | 1/2006 | Bartholomew |
| 7,124,787 | B2 | 10/2006 | Lueschen |
| 7,165,379 | B1 | 1/2007 | Lai |
| 7,210,506 | B2 | 5/2007 | Magno |
| 7,216,679 | B2 | 5/2007 | Magno et al. |
| D543,811 | S | 6/2007 | Lueschen |
| 7,231,944 | B2 | 6/2007 | Magno et al. |
| D547,626 | S | 7/2007 | Lueschen et al. |
| 7,299,830 | B2 | 11/2007 | Levin et al. |
| 7,422,037 | B2 | 9/2008 | Levin et al. |
| 7,591,451 | B2 | 9/2009 | Dyer et al. |
| 8,240,343 | B2 | 8/2012 | Dyer et al. |
| D692,738 | S | 11/2013 | Dyer |
| 8,955,556 | B2 | 2/2015 | Myers et al. |
| 8,960,241 | B2 | 2/2015 | Dyer |
| D732,361 | S | 6/2015 | Dyer |
| D755,029 | S | 5/2016 | Myers et al. |
| D758,155 | S | 6/2016 | Kruzel |
| 9,394,067 | B2 | 7/2016 | Dyer |
| 9,394,068 | B2 | 7/2016 | Dyer |
| 9,481,102 | B1 | 11/2016 | Hojnacki et al. |
| 9,550,590 | B2 | 1/2017 | Dyer |
| 9,694,924 | B2 | 7/2017 | Myers et al. |
| 9,701,428 | B2 | 7/2017 | Welby et al. |
| D818,787 | S | 5/2018 | Kitago |
| 10,259,604 | B2 | 4/2019 | Myers |
| D856,101 | S | 8/2019 | Kitago |
| D878,177 | S | 3/2020 | Kitago |
| D885,861 | S | 6/2020 | Ni |
| 11,008,123 | B2 | 5/2021 | Kitago |
| 11,008,124 | B2 | 5/2021 | Kitago |
| 11,027,902 | B2 | 6/2021 | Geiger et al. |
| 11,377,241 | B2 | 7/2022 | Itatools et al. |
| 11,511,894 | B2 | 11/2022 | Hempe et al. |
| 2002/0093211 | A1 | 7/2002 | Filipiak et al. |
| 2002/0108664 | A1 | 8/2002 | Kurmis |
| 2002/0108665 | A1 | 8/2002 | Thieme |
| 2002/0108666 | A1 | 8/2002 | Kurmis |
| 2002/0108667 | A1 | 8/2002 | Thieme |
| 2002/0108668 | A1 | 8/2002 | Thieme |
| 2002/0129866 | A1 | 9/2002 | Czebatul et al. |
| 2003/0136278 | A1 | 7/2003 | Miyazaki et al. |
| 2004/0079436 | A1 | 4/2004 | Hillegonds |
| 2004/0244606 | A1 | 12/2004 | Haberstroh et al. |
| 2004/0244866 | A1 | 12/2004 | Ishikawa et al. |
| 2005/0178460 | A1 | 8/2005 | Magno |
| 2005/0178461 | A1 | 8/2005 | Magno et al. |
| 2006/0011254 | A1 | 1/2006 | Yokochi et al. |
| 2006/0037661 | A1 | 2/2006 | Lueschen |
| 2007/0157555 | A1 | 7/2007 | Tanner |
| 2007/0199610 | A1 | 8/2007 | Itagaki |
| 2009/0121069 | A1 | 5/2009 | Dyer et al. |
| 2013/0167969 | A1 | 7/2013 | Myers et al. |
| 2013/0167970 | A1 | 7/2013 | Dyer |
| 2015/0053300 | A1 | 2/2015 | Myers et al. |
| 2015/0151862 | A1 | 6/2015 | Kitago |
| 2015/0239588 | A1 | 8/2015 | Kitago |
| 2016/0016682 | A1 | 1/2016 | Boss et al. |
| 2016/0046398 | A1 | 2/2016 | Neeser et al. |
| 2016/0075456 | A1 | 3/2016 | Nomura et al. |
| 2016/0167813 | A1 | 6/2016 | Myers |
| 2016/0230907 | A1 | 8/2016 | Kitago |
| 2016/0280405 | A1 | 9/2016 | Thieme et al. |
| 2017/0057674 | A1 | 3/2017 | Myers |
| 2017/0174374 | A1 | 6/2017 | Figiel et al. |
| 2017/0334587 | A1 | 11/2017 | McFall et al. |
| 2019/0106231 | A1 | 4/2019 | Schwinn et al. |
| 2019/0127095 | A1 | 5/2019 | Kitago |
| 2019/0144149 | A1 | 5/2019 | Dohrmann et al. |
| 2019/0210749 | A1 | 7/2019 | Kitago |
| 2019/0248521 | A1 | 8/2019 | Hillegonds et al. |
| 2020/0391891 | A1 | 12/2020 | Xu |
| 2021/0094713 | A1 | 4/2021 | Hempe et al. |
| 2023/0060775 | A1 | 3/2023 | Hempe et al. |
| 2023/0128208 | A1 | 4/2023 | Dyer |
| 2023/0331412 | A1 | 10/2023 | Fukuda et al. |
| 2024/0116661 | A1 | 4/2024 | Schwinn et al. |

FOREIGN PATENT DOCUMENTS

| | | |
|---|---|---|
| CN | 101486385 | 7/2009 |
| CN | 101585419 | 11/2009 |
| CN | 101983159 | 3/2011 |
| CN | 102859821 | 1/2013 |
| CN | 202670128 | 1/2013 |
| CN | 104870315 | 8/2015 |
| CN | 105059581 | 11/2015 |
| CN | 106742178 | 5/2017 |
| CN | 206579887 | 10/2017 |
| CN | 108791998 | 11/2018 |
| CN | 112550799 | 3/2021 |
| DE | 29617650 | 2/1998 |
| DE | 69728071 | 2/2005 |
| DE | 102013222924 | 5/2015 |
| DE | 102014103334 | 9/2015 |
| DE | 112013000471 | 4/2016 |
| EP | 0722885 | 7/1996 |
| EP | 0839717 | 5/1998 |
| EP | 1564146 | 8/2005 |
| EP | 3068693 | 1/2019 |
| EP | 3666671 | 6/2020 |
| EP | 3712076 | 9/2020 |
| EP | 3466819 | 11/2020 |
| EP | 3483075 | 12/2020 |
| EP | 3747781 | 12/2020 |
| GB | 885371 | 12/1961 |
| IN | 1572657 | 2/2005 |
| JP | H09110010 | 4/1997 |
| JP | H09240617 | 9/1997 |
| JP | 2000103407 | 4/2000 |
| KR | 102267779 | 6/2021 |
| WO | 9815458 | 4/1998 |
| WO | 2009152707 | 12/2009 |
| WO | 2015067444 | 5/2015 |

OTHER PUBLICATIONS

"Extended European Search Report", EP Application No. 18192166.9, Jan. 15, 2019, 5 pages.

"Extended European Search Report", EP Application No. 20198300.4, May 20, 2021, 11 pages.

"Final Office Action", U.S. Appl. No. 16/120,926, Feb. 17, 2022, 13 pages.

"Final Office Action", U.S. Appl. No. 16/120,926, Nov. 15, 2021, 18 pages.

(56) References Cited

OTHER PUBLICATIONS

"Foreign Office Action", CN Application No. 201811344796.7, Jan. 26, 2021, 7 pages.
"Foreign Office Action", CN Application No. 201811167015.1, Apr. 24, 2020, 18 pages.
"Foreign Office Action", CN Application No. 201811167015.1, Jun. 2, 2021, 7 pages.
"Foreign Office Action", CN Application No. 202011032227.6, Jun. 7, 2022, 58 pages.
"Foreign Office Action", CN Application No. 201811344796.7, Jun. 28, 2020, 17 pages.
"Foreign Office Action", CN Application No. 201811167015.1, Dec. 11, 2020, 14 pages.
"Non-Final Office Action", U.S. Appl. No. 17/009,628, Mar. 11, 2022, 23 pages.
"Non-Final Office Action", Application No., May 27, 2020, 13 pages.
"Non-Final Office Action", U.S. Appl. No. 16/163,677, Jun. 1, 2020, 14 pages.
"Non-Final Office Action", U.S. Appl. No. 16/163,677, Jun. 10, 2022, 15 pages.
"Non-Final Office Action", U.S. Appl. No. 17/009,628, Nov. 29, 2021, 20 pages.
"Non-Final Office Action", U.S. Appl. No. 16/163,677, Dec. 7, 2021, 19 pages.
"Notice of Allowance", U.S. Appl. No. 17/009,628, Jul. 29, 2022, 8 pages.
"Notice of Allowance", U.S. Appl. No. 16/163,677, Aug. 25, 2022, 11 pages.
"Today's Mechanisms Mini Test", 4CR—Technological Studies—Retrieved at: gwcts3.blogspot.com/2011/09/todays-mechanisms-mini-test.html—on Nov. 19, 2021, Sep. 16, 2011, 3 pages.
Pishehvari, et al., "Ego-pose estimation via Radar and Openstreetmap-based Scan matching", May 2018, 8 pages.
"Non-Final Office Action", U.S. Appl. No. 29/812,879, May 8, 2023, 5 pages.
"Notice of Allowance", U.S. Appl. No. 18/049,821, Aug. 9, 2023, 8 pages.
"Notice of Allowance", U.S. Appl. No. 29/812,879, Aug. 17, 2023, 6 pages.
"Extended European Search Report", EP Application No., Apr. 25, 2024, 6 pages.
"Foreign Office Action", CN Application No. 202011032227.6, Jun. 7, 2022, 55 pages.
"Foreign Office Action", CN Application No. 202011032227.6, Nov. 3, 2022, 7 pages.
"Foreign Office Action", CN Application No. 202011032227.6, Dec. 16, 2021, 23 pages.
"Non-Final Office Action", U.S. Appl. No. 18/049,821, Mar. 31, 2023, 9 pages.
"Partial European Search Report", EP Application No. 20198300.4, Feb. 18, 2021, 12 pages.
Hellermantyton, "EVO 7 Series & 7i Series Nosepiece, 1/Pkg", Retrieved at: https://www.hellermanntyton.us/products/110-70011/—on Mar. 30, 2022, 1 page.
Hellermantyton, "EVO 7 Series & 7i Series Nosepiece, 1mm tail, 1/pkg", Retrieved at: https://www.hellermanntyton.us/products/110-70131/—on Mar. 30, 2022, 1 page.
Hellermantyton, "EVO 7 Series & 7i Series Nosepiece, 2mm tail, 1/pkg", Retrieved at: https://www.hellermanntyton.us/products/110-70132/—on Mar. 30, 2022, 1 page.
Hellermantyton, "EVO 7 Series & 7i Series Nosepiece, 3mm tail, 1/pkg", Retrieved at: https://www.hellermanntyton.us/products/110-70133/—on Mar. 30, 2022, 1 page.
Hellermantyton, "EVO 9 and EVO 9i 2mm Nosepiece, Extended Tail, 1/pkg", Retrieved at: https://www.hellermanntyton.us/products/110-80064/—on Mar. 30, 2022, 1 page.
Hellermantyton, "EVO 9 and EVO 9i 3mm Nosepiece, Extended Tail, 1/pkg", Retrieved at: https://www.hellermanntyton.us/products/110-80065/—on Mar. 30, 2022, 1 page.
Hellermantyton, "EVO 9 and EVO 9i 4mm Nosepiece, Extended Tail, 1/pkg", Retrieved at: https://www.hellermanntyton.us/products/110-80066/—on Mar. 30, 2022, 1 page.
Hellermantyton, "EVO 9 and EVO 9i 5mm Nosepiece, Extended Tail, 1/pkg", Retrieved at: https://www.hellermanntyton.us/products/110-80067/—on Mar. 30, 2022, 1 page.
Hellermantyton, "EVO 9 Nosepiece Flush Cut, Replacement Part, 1/pkg", Retrieved at: https://www.hellermanntyton.us/products/110-80018/—on Mar. 30, 2022, 1 page.
"Extended European Search Report", EP Application No. 22198311.7, Mar. 13, 2023, 8 pages.

AUTOMATIC BUNDLING TOOL DEVICE

INCORPORATION BY REFERENCE

This application claims priority to German Utility Model Number DE 202022101064.1, filed Feb. 24, 2022, which in turn claims priority to German Utility Model Number DE 202021105310.0, filed Oct. 1, 2021, the disclosures of which are incorporated by reference in their entireties.

BACKGROUND

In order to bundle a bundling good by means of a one-piece-tie, the generalized concept of a cable tie, many non-stationary automatic bundling tools are available. U.S. Pat. No. 9,701,428 B2, for example, describes an apparatus for tensioning a material where the material is tightened by two gears interacting with the material and pulling it into a housing before cutting off a loose end of the material. U.S. Pat. No. 6,981,528 B2 describes an anti jam tensioning gear mechanism for an automatic tie tool head which uses only one gear interacting with the tail of a cable tie used for bundling a bundling good. A similar mechanism is disclosed for a portable cable tie tool in US 2019/248 521 A1.

US 2020/391 891 A1 describes an automatic tying tool with a slider, a guide rail, a first guide claw, a second guide claw, a frame, a tensioning wheel, a cutter, a step-wise material feeding mechanism, and a material pushing rod. First and second guide claws are mounted on a frame via rotation of a central pin. Cutter and tensioning wheel are mounted in the frame. A guide rail is arranged adjacent to the frame. The slider engages with the guide rail. The tying includes a step-wise material feeding mechanism being loaded with cable ties, conveying cable ties at fixed interval in each binding cycle, guiding of the cable ties by a slider from a predetermined position to a binding position, curling tying bodies of ties in guide slots in the first and second guide claws, causing a tail portion to pass through a hole, a window, in the head of the cable ties, tighten the cable ties by rotating the tension wheel, and cutting the tightened cable ties with the cutter. Therein, several rolls are provided that interact with the tensioning wheel to tighten the ties.

DE 10 2013 222 924 A1 describes a portable tool for binding an object, in particular a cable harness, by means of a strap like a cable tie, the portable tool having a tool body with a cycle control and a tensioning device arranged therein, and a drive therefor, the drive being designed as a dual drive in such a way that the cycle control and the tensioning device each have their own drive which are controlled independently by a control device. Therein, a tension wheel and two supporting wheels form a gap through which the strap of a cable tie is pulled by means of the tension wheel in order to tighten the cable tie. The width of the gap is fixed, as supporting rollers and tension wheel are arranged in a fixed relative position to each other. This design was chosen to overcome the disadvantages of a prior design, where the support rollers have been pushed against the tension wheel with a spring force, originally to ensure the grip of the tension wheel on the cable tie strap, effectually resulting in the gear grinding into the strap and causing fine dust (of the cable tie strap) being generated in the housing of the automatic bundling tool device, ultimately causing mechanical problems and failure of said automated binding tool.

However, the high-process capability that can be achieved by the automatic bundling tool of DE 10 2013 222 924 A1 depends on the mechanism that the tension gear is stopped by cable tie when the cable tie is closed and cannot be pulled any further with the tension or tightening force adjusted beforehand. This mechanism needs a very accurate gap width between the tension gear and the fixed tension rollers in order to allow a form fit engagement of the gear with the strap. If the gap is too small, the tie is blocked. If the gap is too large, the tension gear may slip on the serration of the cable tie strap. Therefore, the automatic bundling tool device of DE 10 2013 222 924 A1 can be used only for a very specific thickness of the respective cable tie strap, the necessary tolerances usually being around 0.1 mm.

SUMMARY

This document describes automatic bundling tool devices. In aspects, the automatic bundling tool devices provide an improved automatic bundling tool device overcoming the limitations of the known state of the art, in particular being capable of reliably tightening one-piece-ties with increased tolerance with respect to the one-piece-tie strap thickness. This Summary is provided to introduce simplified concepts of automatic bundling tool devices which are further described below in the Detailed Description and are illustrated in the Drawings. This Summary is not intended to identify essential features of the claimed subject matter, nor is it intended for use in determining the scope of the claimed subject matter.

One aspect relates to an automatic bundling tool device (ATD) configured for bundling a bundling good by means of an one-piece-tie (OPT), with automatically tightening the OPT by the ATD. In particular, said automatic bundling tool device is configured for bundling a bundling good by means of a cable tie with automatically tightening the cable tie by the ATD.

Generally speaking, OPTs are a generalised concept of a standard cable tie, which has a cable tie head part with a window, as well as a cable tie strap or tail part, which is slid through the window in order to form a loop which can be used to bundle cables or alike, where one-piece fixing ties also comprise a neck part, which connects a foot part to the head part, where the foot part comprises some sort of fixing means, for instance in mushroom head part, that can be used to fix the OPT to an object, for instance in an hole of the object. An OPT without neck part/foot part is a standard cable tie. OPTs may be of one or more given types, where the OPTs belonging to different types differ in foot part geometry and/or neck part geometry and/or head part geometry and/or strap part geometry, in particular strap part length and/or strap part thickness. Such OPTs may also be referred to as fixing tie or one-piece fixing tie.

The ATD comprises a tightening mechanism with a tightening gear unit with a tightening gear, and with a tightening roller unit with two tightening rollers. The tightening gear unit can also be referred to as tension gear unit with tension gear, the tightening roller unit also to tension roller unit with two tension rollers. The tightening (or tension) mechanism forms a gap in between the tightening gear and the tightening rollers. The gap is configured to hold a strap part, which may also referred to as tie part, of a respective OPT that is processed by the ATD, that is, used for bundling said bundling good as intended. The tightening gear of the tightening gear unit comprises teeth which are configured to fit into a serration of the OPT's strap part, preferably with a form fit arrangement. Consequently, the automatic bundling tool device is configured for bundling a bundling good using specific given OPTs with corresponding serration on the strap. As OPTs, such as cable ties, are standardized to a very high degree, this prerequisite can be fulfilled by a large variety of OPTs available on the market. In addition, the automatic bundling tool device may be adapted to specifically matching OPTs of a specific company, for instance. Here, the thickness of the OPT strap corresponds to a width of the gap as tightening rollers and tightening gear needs to be in mechanical contact with the strap in order to tighten the OPT, that is, pull the OPT strap and cut it. The width of the gap as well as the thickness of the OPT are measured in a plane perpendicular to rotation axes of tightening gear and tightening rollers.

The tightening roller unit comprises a lever with the two tightening rollers, tightening wheels being arranged on the lever in a first end section of the lever, a turning point of the lever being arranged in a middle section of the lever, and an adjustment element of the tightening roller unit, which is configured for adjusting a width of the gap, being in mechanical contact to a second end section of the lever. Therein, the second end section of the lever is arranged oppositely to the first end section along a main extension direction of the lever. So, first and second end sections each comprise a respective first/second end of the lever, which are diametrically opposite ends in said main extension direction of the lever.

This gives the advantage that the width of the gap can be adjusted with a very high precision as the relationship of the levers can be easily adjusted to reach any desired tolerance for the adjusting of the gap width. Since the turning point is arranged in the middle, the leverage can also be adjusted during the design of the ATD very easily without requiring too much change in the shape of the lever and thus the overall construction of the remaining bundling tool device, where space is scarce. This setup also enables a precise automatic adjustment of the width, as described in more detail below. Consequently, with the precisely adjustable gap between tightening gear and tightening rollers, a form fit, in particular also pinch-free, arrangement of the OPT strap between tightening gear and tightening rollers can be achieved even for different types of OPTs (e.g., OPTs with strap parts of differing thicknesses). Thus, an optimal grip of the tightening gear on the strap can be achieved for OPTs with a range of strap part thickness without the tightening gear grinding into the strap part. As the proposed design allows for an adjustment of the gap width during intended use, be it manually or automatically, such an automatic bundling tool device can also be used for bundling a bundling good with a series of different OPTs with varying thickness. Namely, the gap can be individually adjusted to each and every single OPT processed by the ATD, so that, for example, a harness can be tied with OPTs of different strap thicknesses in different areas of the harness without the need of requiring distinct ATDs.

Alternatively to the arrangement on the lever, the tightening roller unit may comprise the two tightening rollers with respective individual adjustment elements configured to adjust their respective distance to the tightening gear, and thus the gap width. The respective adjustment elements may be or may comprise a linear adjustment element to linearly move the respective tightening roller. Alternatively or in addition, the respective adjustment elements may be or may comprise an eccenter element on which each tightening roller is eccentrically mounted and the distance to the tightening gear can be changed by rotating the eccenter element (i.e., the eccentric). Thus, each of the tightening rollers can be adjusted, preferably independent of one another, in the distance to the tightening gear, resulting in a precise and reliable, dynamic adaptation of the gap to different thicknesses of OPT straps with a form fit. In particular, a pinch-free arrangement of the OPT strap between tightening gear and tightening rollers. Features that are not related to the lever and described in the following may be used to enhance the described alternative without lever.

In an advantageous embodiment, the turning point is essentially aligned with respective rotation axes of the two tightening rollers. Thus, the turning point may be aligned with the rotation axes of the two tightening rollers, e.g., lie on a single straight line with the rotation axes of the two tightening rollers, or aligned up to a preset deviation with the rotation axes of the two tightening rollers. In particular, the preset deviation may be 5°, 2°, or 1°. In order to measure the deviation, one can, in a plane perpendicular to the rotation axis, draw a first straight line through the turning point and the rotation axis that is closer to the turning point, and a second straight line through the two rotation axes of the two tightening rollers. The angle between first and second straight line would be the deviation of the alignment. This alignment has been proven to be particularly useful and in result in an improved pressure of the tightening rollers onto strap part and tightening gear.

In another advantageous embodiment, a rotation axis of the tightening gear, as well as, a middle point of a straight line connecting the rotation axes of the two tightening rollers are, in a plane perpendicular to said rotation axis, arranged in essentially the same distance from the turning point. So, said middle point and the rotation axis of the tightening gear are, most preferably, arranged on a circle with the turning point as centre. The distances from the turning point do not need to be exactly the same for achieving already a large part of the advantageous improved grip. In particular, they may deviate from each other by a preset deviation of less than 10%, less than 5%, or less than 2% of the distance between the rotation axes of the two tightening rollers. So, for example, in a specific setup, the rotation axes of the two tightening rollers may be arranged in a straight line, and the rotation axis of the tightening gear may be arranged, in an orthogonal projection onto the straight line connecting the rotation axes of the two tightening rollers, in the middle between the rotation axes of the two tightening rollers for a given width of the gap. This specific arrangement further optimizes the distribution of forces on the cable tie.

In another advantageous embodiment, a first distance between the two tightening rollers and the turning point is smaller than a second distance between the turning point and a point of mechanical contact of the adjustment element and the second end section. In particular, the second distance is at least twice, preferably at least thrice the first distance. This gives the advantage that the gap through which the strap of the OPT is pulled can be adjusted very finely.

In another advantageous embodiment, the tightening mechanism features a first stopper and/or a second stopper that respectively predetermine a fixed first limit, a lower limit, and/or, respectively, a fixed second limit, an upper limit, for the width of the gap. This gives the advantage of a very precise setting of boundary conditions that can be used to prevent a slipping of the strap part by setting a suitable upper limit, and to prevent grinding of the gear wheel into the strap by setting a suitable lower limit, which is suitable for the specific OPT the ATD is configured to be used with in the specific application at hand.

In a further advantageous embodiment, the tightening mechanism comprises a spring element which is in mechanical contact with the second end section of the lever and is configured to exert a spring force on the second end section for holding the tightening rollers close to the tightening gear. So, the spring element effectively pushes the tightening rollers towards the strap, where a negative side-effect of an excessive force on the strap may be prevented by the above-referenced stoppers, for example, or a respective adjustable spring element, as described in the next paragraph. Yet, the use of the spring element allows an automatic self-adjustment of the gap width to irregularities in the thickness of the respective OPT strap, which further enhances performance of the ATD.

Preferably, the spring element is an adjustable spring element, with the position of the adjustable spring element relative to the second end section of the lever being adjustable for adjusting the relative position of the tightening rollers close to the tightening gear. Furthermore, by changing the position of the adjustable spring element in suitable conjunction with the above-mentioned stopper element, also the spring force exerted on the cable tie strap can be adjusted without the gap width falling below said lower limit for the width of the gap. Thus, the ATD can be configured to adapt in a desired way to irregularities or variance of thickness in ATD straps as independent parameters.

In an embodiment, the adjustment element comprises an excentric shaft which is in mechanical contact with the second end section of the lever, where the adjustment element is configured to adjust a minimal and/or maximal distance of the tightening rollers to the tightening gear roller by a rotation of the excentric shaft, thus adjusting a distance from rotation axis of the excentric shaft and contact surface of the lever, ultimately resulting in an adjustment of the distance of the tightening rollers to the tightening gear, thus the width of the gap. This gives the advantage that in particular the minimal distance, thus the lower limit for the width of the gap can be adjusted exactly, which can be used to guarantee a pinch-free arrangement for OPTs with straps of variable thickness.

In a further embodiment, the tightening mechanism comprises a motor for automatically adjusting the relative position of the tightening rollers relative to the tightening gear via adjusting the position of the adjustable spring element and/or for automatically adjusting the minimal distance of the tightening rollers to the tightening gear via rotating of the excentric shaft in response to a control signal of a control unit. This gives the advantage that the ATD can cope with different thicknesses of OPT straps and requires only a corresponding control signal to do so.

The features and combinations of features described above, including the general part of the description, as well as the features and combinations of features disclosed in the Detailed Description or the Figures alone may not only be used alone or in the described combination, but also with other features or without some of the disclosed features without departing the scope of the present disclosure. Consequently, embodiments that are not explicitly shown and described by the Figures but that can be generated by separately combining the individual features disclosed in the Figures are also part of the present disclosure. Therefore, embodiments and combinations of features that do not comprise all features of an originally formulated independent claim are to be regarded as disclosed. Furthermore, embodiments and combinations of features that differ from or extend beyond the combinations of features described by the dependencies of the claims are to be regarded as disclosed.

BRIEF DESCRIPTION OF THE DRAWINGS

Example embodiments are further described in the following by means of schematic drawings. Therein.

In the different Figures, identical or functionally identical features have the same reference signs.

DETAILED DESCRIPTION

The disclosure relates to an automatic bundling tool device (ATD) for bundling a bundling good by means of a one-piece-tie (OPT), with automatically tightening the OPT by the ATD. In particular, the automatic bundling tool device is configured for bundling a bundling good by means of a cable tie, as a special case of OPT, with automatically tightening the cable tie by the ATD. The ATD includes a tightening mechanism with a tightening gear unit with a tightening gear, and a tightening roller unit with two tightening rollers, which forms a gap in between tightening gear and tightening rollers. The gap is configured to hold a strap of a respective OPT processed by the ATD. The tightening gear of the tightening gear unit includes teeth which are configured to fit into a serration of the OPT's strap.

Figure 1:
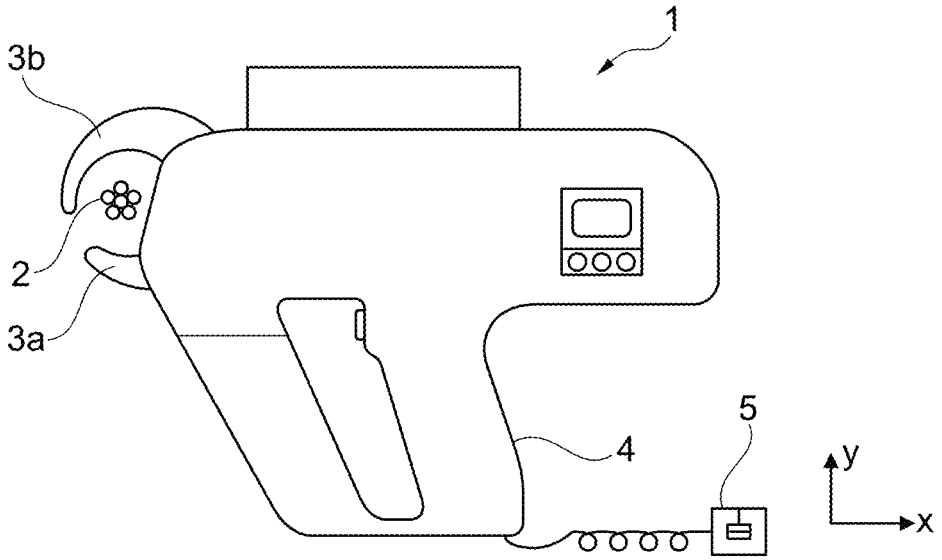
FIG. 1 shows an example embodiment of an automatic bundling tool device, ATD.
Figure 2:
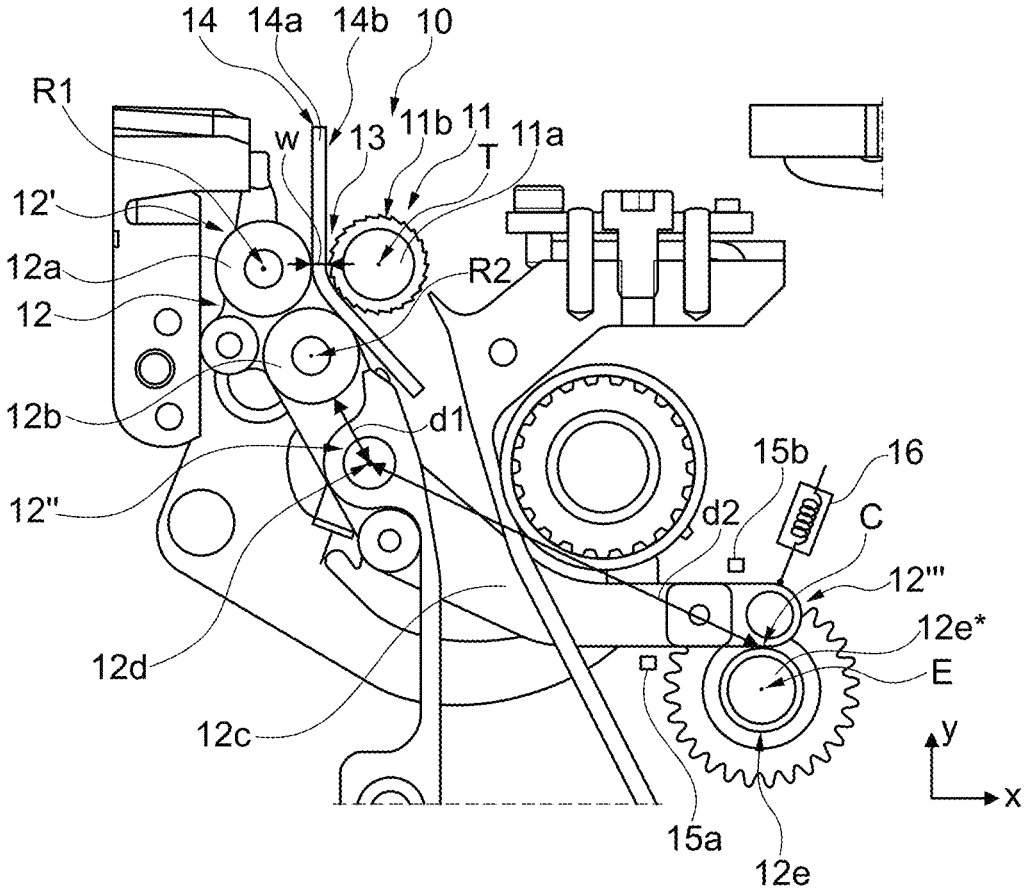
FIG. 2 shows details of an example tightening mechanism of an ATD.

FIG. 1 shows an example embodiment of an automatic bundling tool device 1 (ATD 1), for bundling a bundling good 2 by means of a one-piece-tie 14 (OPT 14) (FIG. 2). Therein, two claws 3*a*, 3*b* are configured to grab around the bundling good 2 and guide said one-piece-tie around the bundling good 2 before it is pulled back into a housing 4 of the ATD 1 by a tightening mechanism 10 (FIG. 2). The claws may also be referred to as jaws. In the present example, the ATD 1 is also connected with a control unit 5 that provides control signals to the ATD and the tightening mechanism 10.

FIG. 2 shows an example embodiment of a tightening mechanism 10 with a tightening gear unit 11 that comprises a tightening gear 11*a*, and with a tightening roller unit 12 with two tightening rollers 12*a*, 12*b*, forming a gap 13 between tightening gear 11*a* and tightening rollers 12*a*, 12*b*. The gap 13 is configured to hold a strap 14*a* of the OPT 14 that is to be processed by the ATD 1. The tightening gear 11*a* comprises teeth 11*b* which are configured to fit in a serration 14*b* of the OPT strap 14*a*.

The tightening roller unit 12 comprises a lever 12*c* with the two tightening rollers 12*a*, 12*b* being arranged on the lever 12*c* in a first end section 12' of the lever 12*c*, a turning point 12*d* in a middle section 12" of the lever 12*c*, and an adjustment element 12*e* being in mechanical contact to a second end section 12''' of the lever 12*c*. The second end section 12''' is arranged oppositely to the first end section 12' along a main extension direction of the lever 12*c*. The adjustment element 12*e* is configured to adjust a width w of the gap 13.

In the present example, this adjustment of the width w of the gap 13 is achieved by an excentric shaft 12*e as part of the adjustment element 12***e* which is in mechanical contact with the second end section 12''' of the lever 12*c*, where, in the present example, a minimal distance of the tightening rollers 12*a*, 12*b* to the tightening gear 11*a* can be adjusted by a rotation of the excentric shaft 12*e around a rotation axis E of the excentric shaft 12*e.

Furthermore, in the present example, the turning point 12*d* is aligned with the rotation axes R1, R2 of the two tightening rollers 12*a*, 12*b*. Therein, a first distance d1 between the two tightening rollers 12*a*, 12*b* and the turning point 12*d* is smaller than a second distance d2 between the turning point 12*d* and a point of mechanical contact C of the adjustment element 12*e* and the second end section 12'''.

In the shown example, the tightening mechanism also comprises a first stopper 15*a* and a second stopper 15*b* that respectively predetermine a fixed lower and fixed upper limit, respectively, for the width w of the gap 13. In addition, in the present example, the tightening mechanism 10 comprises a spring element 16 which is in mechanical contact with the second end section 12''' of the lever 12*c* and is configured to exert a spring force on the second end section 12''' for holding the tightening rollers 12*a*, 12*b* close to the tightening gear 11*a*, in the present example as close to the tightening gear 11*a* as the adjusting element 12*e* allows.

Figure 3:
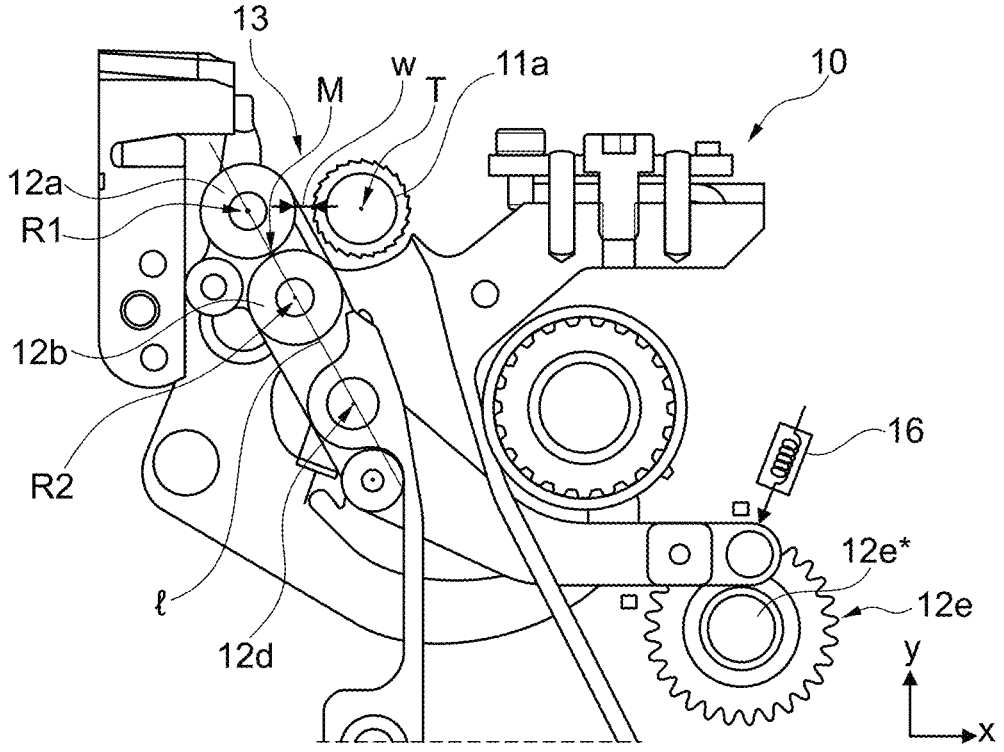
FIG. 3 shows the example tightening mechanism of FIG. 2 in a second configuration.

FIG. 3 shows the tightening mechanism 10 of FIG. 2 with the gap 13 adjusted for a different, smaller width w than in FIG. 2. Note that, as compared to FIG. 2, the excentric shaft 12*e of the adjustment element 12***e* is rotated in order to turn the lever 12*c* around the turning point 12*d* and thus move the tightening rollers 12*a*, 12*b* closer to the tightening gear 11*a* than shown in FIG. 2, in particular, allow the spring element 16 to push the tightening rollers 12*a*, 12*b* further towards the tightening gear 11*a*. Note that, in the present example, the turning point 12*d* is aligned with the rotation axes R1, R2 of the two tightening rollers 12*a*, 12*b*, as they are all on the same line 1 (line l). Furthermore, in an orthogonal projection of the rotation axis T of the tightening gear 11*a* on said line 1, the rotation axis T is projected onto a middle point M on the line 1 in the middle between the rotation axes R1, R2 on the line l. Thus, said middle point M and the rotation axis T approximately lie on a circle with a given radius and centre as turning point 12*d*.

Unless context dictates otherwise, use herein of the word "or" may be considered use of an "inclusive or," or a term that permits inclusion or application of one or more items that are linked by the word "or" (e.g., a phrase "A or B" may be interpreted as permitting just "A," as permitting just "B," or as permitting both "A" and "B"). Also, as used herein, a phrase referring to "at least one of" a list of items refers to any combination of those items, including single members. For instance, "at least one of a, b, or c" can cover a, b, c, a-b, a-c, b-c, and a-b-c, as well as any combination with multiples of the same element (e.g., a-a, a-a-a, a-a-b, a-a-c, a-b-b, a-c-c, b-b, b-b-b, b-b-c, c-c, c-c-c, or any other ordering of a, b, and c). Further, items represented in the accompanying figures and terms discussed herein may be indicative of one or more items or terms, and thus reference may be made interchangeably to single or plural forms of the items and terms in this written description.

Although implementations of automatic bundling tool devices have been described in language specific to certain features and/or methods, the subject of the appended claims is not necessarily limited to the specific features or methods described. Rather, the specific features and methods are disclosed as example implementations of automatic bundling tool devices.

What is claimed is:

1. A bundling tool device configured for bundling a bundling good with a one-piece-tie (OPT) and configured for automatically tightening the OPT, the bundling tool device comprising:

a tightening mechanism with a tightening gear unit with a tightening gear, and with a tightening roller unit with two tightening rollers, forming a gap in between tightening gear and tightening rollers, where the gap is configured to hold a strap of a respective OPT processed by the bundling tool device, and the tightening gear of the tightening gear unit comprises teeth which are configured to fit into a serration of the strap, wherein the tightening roller unit comprises a lever with the two tightening rollers being arranged on the lever in a first end section of the lever, a turning point of the lever being arranged in a middle section of the lever, and an adjustment element of the tightening roller unit, being in mechanical contact to a second end section of the lever, which is arranged oppositely to the first end section along a main extension direction of the lever, the adjustment element comprising an excentric shaft, the excentric shaft in mechanical contact with the second end section of the lever, the adjustment element configured to adjust a minimal distance of the tightening rollers to the tightening gear by a rotation of the excentric shaft.

2. The bundling tool device of claim 1, wherein the turning point is essentially aligned with rotation axes of the two tightening rollers.

3. The bundling tool device of claim 1, wherein a rotation axis of the tightening gear and a middle point of a straight line connecting the rotation axes of the two tightening rollers have essentially the same distance from the turning point.

4. The bundling tool device of claim 1, wherein a first distance between the two tightening rollers and the turning point is smaller than a second distance between the turning point and a point of mechanical contact of the adjustment element and the second end section.

5. The bundling tool device of claim 4, wherein the second distance is at least twice the first distance.

6. The bundling tool device of claim 1, wherein the tightening mechanism comprises a spring element which is in mechanical contact with the second end section of the lever, the spring element configured to exert a spring force on the second end section for holding the tightening rollers close to the tightening gear.

7. The bundling tool device of claim 6, wherein the spring element is an adjustable spring element, with a position of the adjustable spring element relative to the second end section of the lever being adjustable for adjusting a position of the tightening rollers relative to the tightening gear.

8. The bundling tool device of claim 1, wherein the tightening mechanism comprises a motor for automatically adjusting at least one of:

a position of the tightening rollers relative to the tightening gear in response to a control signal of a control unit; or a minimal distance of the tightening rollers to the tightening gear in response to a corresponding control signal.

9. The bundling tool device of claim 1, wherein the tightening mechanism includes at least one of:

a first stopper that predetermines a fixed first limit and a lower limit for a width of the gap; or a second stopper that predetermines a fixed second limit and an upper limit for the width of the gap.

10. The bundling tool device of claim 1, wherein the turning point is essentially aligned with rotation axes of the two tightening rollers, and wherein a rotation axis of the tightening gear and a middle point of a straight line connecting the rotation axes of the two tightening rollers have essentially the same distance from the turning point.

11. The bundling tool device of claim 1, wherein the turning point is essentially aligned with rotation axes of the two tightening rollers, and wherein a first distance between the two tightening rollers and the turning point is smaller than a second distance between the turning point and a point of mechanical contact of the adjustment element and the second end section.

12. The bundling tool device of claim 1, wherein the turning point is essentially aligned with rotation axes of the two tightening rollers, and wherein the tightening mechanism comprises a spring element which is in mechanical contact with the second end section of the lever, the spring element configured to exert a spring force on the second end section for holding the tightening rollers close to the tightening gear.

13. The bundling tool device of claim 1, wherein the turning point is essentially aligned with rotation axes of the two tightening rollers, and wherein the adjustment element comprises an excentric shaft, the excentric shaft in mechanical contact with the second end section of the lever, where the adjustment element is configured to adjust a minimal distance of the tightening rollers to the tightening gear by a rotation of the excentric shaft.

14. The bundling tool device of claim 1, wherein the turning point is essentially aligned with rotation axes of the two tightening rollers, and wherein the tightening mechanism includes at least one of:

a first stopper that predetermines a fixed first limit and a lower limit for a width of the gap; or a second stopper that predetermines a fixed second limit and an upper limit for the width of the gap.

15. The bundling tool device of claim 1, wherein a rotation axis of the tightening gear and a middle point of a straight line connecting the rotation axes of the two tightening rollers have essentially the same distance from the turning point, and wherein a first distance between the two tightening rollers and the turning point is smaller than a second distance between the turning point and a point of mechanical contact of the adjustment element and the second end section.

16. The bundling tool device of claim 1, wherein a first distance between the two tightening rollers and the turning point is smaller than a second distance between the turning point and a point of mechanical contact of the adjustment element and the second end section, and wherein the tightening mechanism comprises a spring element which is in mechanical contact with the second end section of the lever, the spring element configured to exert a spring force on the second end section for holding the tightening rollers close to the tightening gear.

17. A bundling tool device configured for bundling a bundling good with a one-piece-tie (OPT) and configured for automatically tightening the OPT, the bundling tool device comprising:

a tightening mechanism with a tightening gear unit with a tightening gear, and with a tightening roller unit with two tightening rollers, forming a gap in between tightening gear and tightening rollers, where the gap is configured to hold a strap of a respective OPT processed by the bundling tool device, and the tightening gear of the tightening gear unit comprises teeth which are configured to fit into a serration of the strap, wherein the tightening roller unit comprises the two tightening rollers with respective individual adjustment elements configured to adjust their respective distance to the tightening gear, and thus a width of the gap, and wherein the tightening mechanism comprises a motor for automatically adjusting at least one of:

a position of the tightening rollers relative to the tightening gear in response to a control signal of a control unit; or a minimal distance of the tightening rollers to the tightening gear in response to a corresponding control signal.

18. The bundling tool device of claim 17, wherein the tightening mechanism includes at least one of:

a first stopper that predetermines a fixed first limit and a lower limit for the width of the gap; or a second stopper that predetermines a fixed second limit and an upper limit for the width of the gap.

19. A bundling tool device configured for bundling a bundling good with a one-piece-tie (OPT) and configured for automatically tightening the OPT, the bundling tool device comprising:

a tightening mechanism with a tightening gear unit with a tightening gear, and with a tightening roller unit with two tightening rollers, forming a gap in between tightening gear and tightening rollers, where the gap is configured to hold a strap of a respective OPT processed by the bundling tool device, and the tightening gear of the tightening gear unit comprises teeth which are configured to fit into a serration of the strap, wherein the tightening roller unit comprises a lever with the two tightening rollers being arranged on the lever in a first end section of the lever, a turning point of the lever being arranged in a middle section of the lever, and an adjustment element of the tightening roller unit, being in mechanical contact to a second end section of the lever, which is arranged oppositely to the first end section along a main extension direction of the lever, and wherein the turning point is essentially aligned with rotation axes of the two tightening rollers, and wherein the adjustment element comprises an excentric shaft, the excentric shaft in mechanical contact with the second end section of the lever, where the adjustment element is configured to adjust a minimal distance of the tightening rollers to the tightening gear by a rotation of the excentric shaft.

20. The bundling tool device of claim 19, wherein the turning point is essentially aligned with rotation axes of the two tightening rollers.

* * * * *